US008327590B2

(12) United States Patent
Ray

(10) Patent No.: US 8,327,590 B2
(45) **Date of Patent: *Dec. 11, 2012**

(54) ROOFING SYSTEM SUPPORT ASSEMBLY

(76) Inventor: Gino Ray, Slidell, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/373,052

(22) Filed: Nov. 3, 2011

(65) Prior Publication Data

US 2012/0042597 A1 Feb. 23, 2012

Related U.S. Application Data

(63) Continuation-in-part of application No. 12/460,638, filed on Jul. 22, 2009, now Pat. No. 8,061,087.

(51) Int. Cl.
*E04B 7/02* (2006.01)

(52) U.S. Cl. ..... 52/90.2; 52/66; 52/22; 52/336; 52/749.12; 52/203

(58) Field of Classification Search ..... 52/90.1, 52/90.2, 66, 22, 643, 276, 93.2, 648.1, 302.1, 52/198, 336, 506.06, 508, 749.12, 203
See application file for complete search history.

(56) References Cited

U.S. PATENT DOCUMENTS

| | | | | |
|---|---|---|---|---|
| 2,284,898 | A | 6/1942 | Hartman | |
| 3,583,121 | A | 6/1971 | Tate et al. | |
| 3,845,930 | A | 11/1974 | Metrailer | |
| 4,263,763 | A | 4/1981 | Bouwens | |
| 4,314,428 | A | 2/1982 | Bromwell | |
| 4,494,342 | A | 1/1985 | Decker | |
| 4,524,554 | A | 6/1985 | Simpson | |
| 4,593,509 | A | 6/1986 | Linton | |
| 4,608,791 | A | 9/1986 | McClure | |
| 4,620,397 | A | 11/1986 | Simpson et al. | |
| 4,651,493 | A | 3/1987 | Carey | |
| 4,691,491 | A | 9/1987 | Lilley | |
| 4,796,403 | A * | 1/1989 | Fulton et al. | 52/713 |
| 5,005,323 | A | 4/1991 | Simpson et al. | |
| 5,038,529 | A | 8/1991 | Conley et al. | |
| 5,127,205 | A | 7/1992 | Eidson | |
| 5,511,354 | A | 4/1996 | Eidson | |
| 5,704,170 | A | 1/1998 | Simpson | |
| 5,743,063 | A | 4/1998 | Boozer | |
| 6,301,853 | B1 | 10/2001 | Simpson et al. | |
| 6,397,527 | B1 | 6/2002 | Pellock | |
| 6,401,286 | B1 * | 6/2002 | Brenn | 14/73 |
| 7,208,081 | B2 | 4/2007 | Jones | |
| 7,703,256 | B2 * | 4/2010 | Haddock | 52/543 |
| 8,061,087 | B2 * | 11/2011 | Ray | 52/90.2 |

* cited by examiner

*Primary Examiner* — William Gilbert
*Assistant Examiner* — Chi Nguyen
(74) *Attorney, Agent, or Firm* — Keaty Law Firm

(57) ABSTRACT

A support assembly for supporting a retrofit roof to be installed above an existing roof made of preformed panels. Elongated support assembly members are positioned along the roof line to provide additional points of attachment for the new roof, while at the same time forming a substantially even plane for new roof panels. Some of the support members fit in the channels between the ridges of the preformed panels, which can be R-panels or standing seam panels. Transverse top members secure the channel-mounted members in place, while strapping members positioned atop the top members form additional lateral support for the new roof. A plurality of bracket support assemblies is secured between the top members to the roofing panels to elevate the new roof support. The bracket support assemblies are formed of two engageable parts to increase resistance to wind forces.

20 Claims, 4 Drawing Sheets

ROOFING SYSTEM SUPPORT ASSEMBLY

CROSS-REFERENCE TO RELATED APPLICATIONS

This application is a continuation-in-part of my co-pending application

Serial No. 12/460,638 filed on Jul 22, 2009 entitled "Retrofit Framing System for Metal Roof," now patent No. 8,061,087, the full disclosure of which is incorporated by reference herein, and priority of which is hereby claimed.

BACKGROUND OF THE INVENTION

This invention relates to roofing systems, and, more particularly to a support assembly for retrofitting a roof made of preformed panels in order to improve wind pressure resistance of a new roof.

The typical roof in a high wind weather condition is degraded and eventually destroyed because one or more roofing panels and/or the ridge caps are lifted off of the structure. When this happens, the entire roof is quickly peeled off of the building and the rest of the building is exposed to the weather. Older roofs, especially those constructed according to the earlier building codes, are particularly susceptible to wind pressure because there are not enough points of attachment of the roof panels to the underlying roof support structure, such as a plywood deck, rafters or purlins.

Rapid changes in the roofing systems bring new concepts to the roofing material development. For instance, preformed metal panels are replacing standing seam roof, and single-ply membrane is replacing the old-fashioned built-up roof. Preformed metal panels are often made of galvanized steel with the panel lengths between 6 and 40 feet and panel widths in the order of 26-38". The preformed metal panels may have different patterns, or profiles, wherein the high ridges of the panel are integrally formed with low-profile drain channels. The panels are typically nailed along the drain channels at spaced intervals according to the manufacturer's specifications.

In the geographic areas where hurricanes happen every year, the nailed-down preformed metal roofs often fail, when high velocity winds rip off the roof from the building. Often times, water and wind enter under the edges of the roof panels and ridge cap thus exposing the building interior to the inclement weather. The purpose of this invention is to provide a roofing system support assembly that would increase the roofs resistance to winds of extreme force. With roofing panels, the present invention will confer resistance to all winds, not depending on thru fasteners or flashing with caulk.

SUMMARY OF THE INVENTION

It is, therefore, an object of this invention to provide a retrofitting assembly for retrofitting existing metal roofs with supports for positioning of a new roof.

It is another object of the invention to provide a retrofitting assembly designed to increase wind resistance of the roof.

It is a further object of the invention to provide a retrofitting assembly for reinforcing the roof structure that can be installed on top of the existing roof panels without the need to replace the roof.

It is still a further object of the invention to provide a retrofitting assembly that can be installed on an existing roof and bring the roof into compliance with current building codes without the need to replace the entire roof.

It is another object of the invention to provide a novel bracket support assembly that increases roof's resistance to strong winds.

These and other objects of the invention are achieved through a provision of a roofing system assembly for retrofitting an existing roof formed of preformed roof panels having elevated ridges and drain channels, with new roofing panels, while correcting any uneven planes of the existing roof. The assembly comprises a plurality of support members formed from a corrosion-resistant bendable material, such as for instance galvanized steel, tin, or aluminum. The support assembly comprises a plurality of elongated first bottom members configured to fit into drain channels and be secured to the preformed roof panels of the existing roof to extend about a peripheral line of the roof. Each of the first bottom members has a height at least equal to the height of a ridge of the preformed roof panel so as to support a new roof along an even plane. The assembly also comprises a plurality of elongated first top members configured to extend transversely to the first bottom members and be secured at a level above the elevated ridges of the preformed roof panels and a plurality of bracket support assemblies configured to be positioned in the drain channels and be secured to the preformed roof panels of the existing roof and to the first top members for supporting the first top members at a desired elevation above the elevated ridges of the preformed roof panels.

Elongated strapping members extend transversely to and are configured to be secured to the first top members in substantially parallel relationship to the first bottom members. A second top member is configured for securing along the peripheral edge of the existing roof between the first bottom member and the strapping member. When secured to the existing roof panels, the support assembly forms a framework, to which new roofing panels may be secured.

The invention also provides for a novel bracket support assembly for use in retrofitting and other roofing applications. Each bracket support assembly has a generally L-shaped first bracket support member and a second bracket support member fitted over the horizontal part of the L-shaped first bracket support member. Indentations formed in the horizontal part and the second bracket support member are designed to snap together and affix the second bracket support member in relation to the first bracket support. The second bracket support member has a planar body with upright flanges extending along three sides of the planar body. The novel bracket support assembly is designed to substantially increase resistance of the roofing elements to wind forces.

The new support assembly provides considerable larger number of attachment points for the new roof, particularly along the peripheral roof line. As a result, wind pressure resistance of the building roof is significantly increased.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
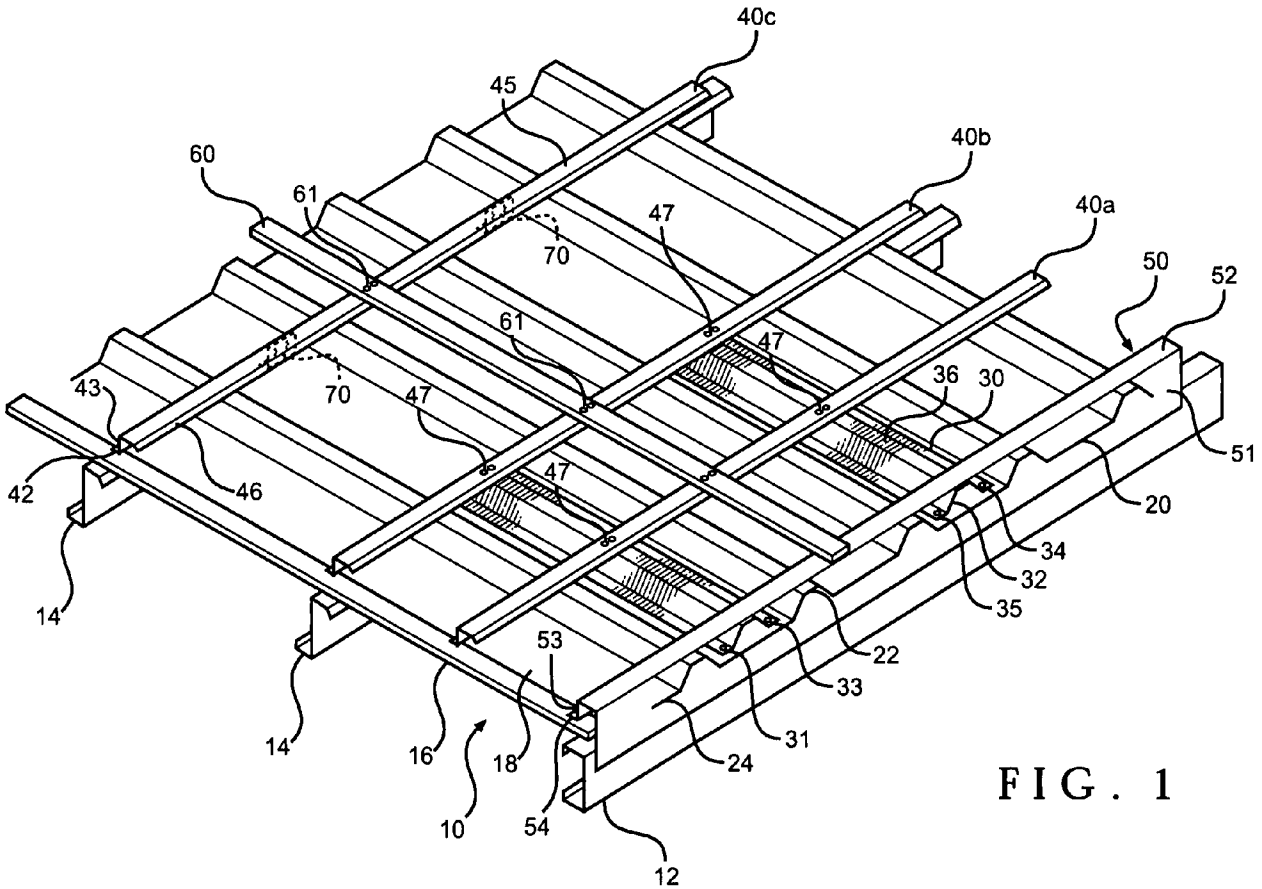
FIG. 1 is a perspective view of a roof having preformed metal panels and having the bracket support assembly of the instant invention installed thereon.

Turning now to the drawings in more detail, numeral 10 designates an existing roof made of preformed metal panels 18. The roof illustrated in the drawings is a standard R-panel roof, which is typically made of galvanized steel. Another frequently used alternative in roof panels is the so-called standing seam roof. An eave 12 forms the edge of the roof supporting structure and somewhat projects beyond the side of the building.

A plurality of purlins 14 extends in a generally parallel relationship to the roof edge; the purlins 14 support the loads from the roof deck or sheathing 16. The purlins 14 are supported by the principal rafters and/or the building walls (not shown). As can be seen in the drawings, conventional purlins 14 are formed of Z-shaped sections; they can be formed of cold-formed steel. The purlins 14 are spaced from each other by about 4 feet. The roof panels 18 are corrugated, with high ridges 22 alternating with drain channels 24.

A first bottom support member 30 is configured to fit within the channel 24. The first bottom support member 30 has a length sufficient to extend between a peripheral edge 20 of the panel 18 and at least the first purlin 14. A plurality of bottom support members 30 is positioned in the drain channels 24 at pre-determined spaced intervals. Depending on the condition of the old roof, a first bottom member may be positioned in every drain channel 24 or every other drain channel 24, or at any other desired spacing.

Each bottom support member 30 has a pair of sloping sides 32, 34 joined by an elevated flat ridge 36. A flange 31 extends outwardly from a lower end of the side 32, and a mirror-image flange 33 extends outwardly from a lower end of the side 34. The flanges 31 and 33 are configured to be secured to the roof panels 18 by nails or screws 35. The height of the first bottom member, that is the distance by which the flat ridge 36 extends above the flanges 31, 33, is at least equal to, or slightly greater than the distance between the plain of the drain channel 24 and the high ridge 22.

Extending transversely to the longitudinal axis of the first bottom member 30 is an elongated first top member 40. The body of the first top member 40 has a generally Z-shaped configuration in cross-section; it is configured to rest on the first bottom member 30, as shown in FIG. 1, and be attached thereto by nails or screws. The first top member 40 has a first horizontal part 42, a vertical part 43, a second horizontal part 45 and an angularly descending part 46. The first horizontal part 42 is configured to rest on the first bottom member 30, as shown in FIG. 1, and be attached thereto by nails or screws. The second horizontal part 45 supports a strapping member 60, as will be described below.

The roofing system uses of at least one, and preferably several first top members 40. A first top member 40*a* is secured to the first bottom members 30. In one of the preferred embodiments another first top member 40*b* is secured a predetermined distance from the first top member 40*a*, and still another first top member 40*c* is secured a distance inwardly of the first top member 40*b* to provide structural support for the strapping member 60. The first top members 40*a* and 40*b* are secured to the first bottom members 30 by screws or nails 47.

Additional first top members 40 are installed at eaves, rakes and ridges over previously installed first bottom members 30. The first top members 40 help in converting existing roof structure and obtain higher wind pressure resistance (wind load rating) or to meet new building codes. The first top members 40 can be secured at various points along the vertical part of the Z-shaped body, thus allowing the installer to slightly elevate the elongated first top member 40 to the desired height and achieve an even roof line, as described below.

A second top member 50 is secured along the edge of the roof panels 18 in a covering relationship over the edge of the roof panels 18 and the outer ends of the first bottom members 30. As can be seen in FIG. 1, the second top member 50 comprises a first longer elongated vertically extending segment 51, a first or upper horizontal segment 52, a second or shorter vertical segment 53 and a second or lower horizontal segment 54. The size and the angle of connection between the long vertical segment 51 and the upper horizontal segment 52 is determined by the configuration of the existing structure; the length of the long segment 51 is determined by the height of the first bottom members 30. Similar to the first top member 40, the second top member 50 can be made from galvanized steel. The segments 51, 52, 53 and 54 can be formed unitary, if desired.

When the second top member 50 is positioned on the first bottom member 30, it rests on the flat ridge of the first bottom member 30, and the long vertical segment 51 partially covers the eave 12. When the strapping members 60 are positioned on the roof they rest on, and are secured to, the upper horizontal segment 52 of the second top member 50, as shown in FIG. 1. An optional gutter member may be secured to the vertical portion of the first top member.

The strapping members 60 span from the second top member 50 toward the field of the roof, preferably to the ridge of the roof 10. The lateral strapping members 60 can be formed from sheet metal about 2 inches wide. As discussed above, the strapping members 60 are attached to the second top members 40 by flat head screws or tapping screws 61.

Figure 2:
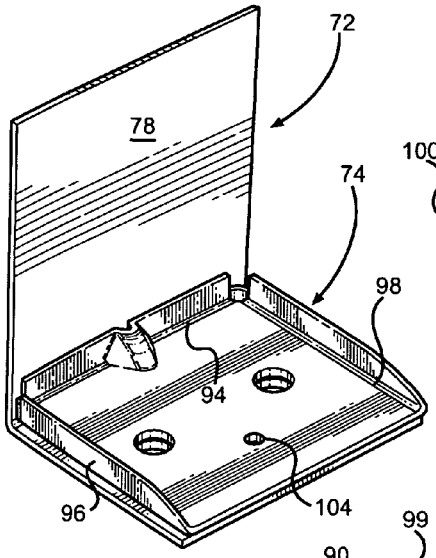
FIG. 2 is a perspective view of the bracket support assembly according to the first embodiment of the present invention.

The strapping members 60 are spaced from each other, with the distance between the strapping members to be determined on site by an engineer or by the requirements of the wind load resistance. The strapping members are made of thin piece of tin or galvanized steel. The strapping members 60 can span from one edge of the roof to another edge to form lateral support for a new roof Alternatively, the strapping members 60 can stop at the ridge of the roof, and another strapping member 60 can start to span to another edge of the roof The first top member 40*c* is secured to the roof panels 18 by bracket support assemblies 70, which are spaced from each other as shown in FIG. 1. The bracket support assemblies 70 comprise an L-shaped first bracket member 72 and a second bracket member 74, which is configured to detachably engage the first bracket member 72, as shown in FIG. 2. The first bracket member 72 comprises a horizontal part 76 configured for attachment to the roof panels 18 and a vertical part 78 that fits against the horizontal part 45 of the first top member 40*c* (see FIG. 1), while being secured to the second vertical part 43. The vertical part 78 of the first bracket member 72 can be made of any required height to allow the first top member 40*c* to be elevated from the surface of the roofing panel 18 and form a straight roof line.

A pair of apertures 80, 82 is formed in the horizontal part 76 in a spaced-apart relationship. Securing fasteners, such as screws or nails (not shown) extend through the apertures 80, 82 to attach the horizontal part 76 to the roof panels. An indentation 84 is formed in the horizontal part 76 centrally along an inner edge 77 of the horizontal part 76. The indentation 84 extends outwardly and upwardly from the inner edge 77, which serves as a connecting line between the horizontal part 76 and the vertical part 78.

The second bracket member 74 comprises a planar member 86, which has an area at least slightly smaller than the area of the horizontal part 76. When the second bracket member is engaged with the first bracket member 72 as shown in FIG. 2, the planar member 86 rests on top of the horizontal part 76. A pair of spaced-apart openings 87, 88 is formed in the planar member in alignment with the apertures 80, 82 in the horizontal part 76 and configured to receive fastening elements, such as screws or nails therethrough.

The planar member 86 is provided with upwardly extending flanges 90, 91, and 92, which extend at a right angle to the top surface of the planar member 86. The inner flange 90 extends along and upwardly from an inner edge 94 of the planar member 86. The side flanges 91 and 92 extend from sides 96 and 98 of the planar member 86. If desired, the side flanges 91 and 92 can be shaped triangular in cross section, gradually decreasing in height from the inner edge 94 to an outer edge 95 of the planar member 86.

A central indentation 99 is formed in the planar member 86 and the inner flange 90. The indentation 99 follows the configuration of the indentation 84 formed in the horizontal part 76. When the second bracket member 74 is engaged with the first bracket member 72 the indentations 99 and 84 are aligned allowing the second bracket member 74 to snap into engagement with the first bracket member 72.

Figure 3:
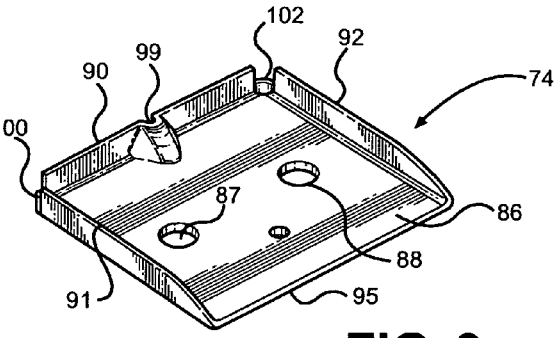
FIG. 3 is a detail perspective view of the reinforcement member for use in the bracket support assembly of the first embodiment.
Figure 4:
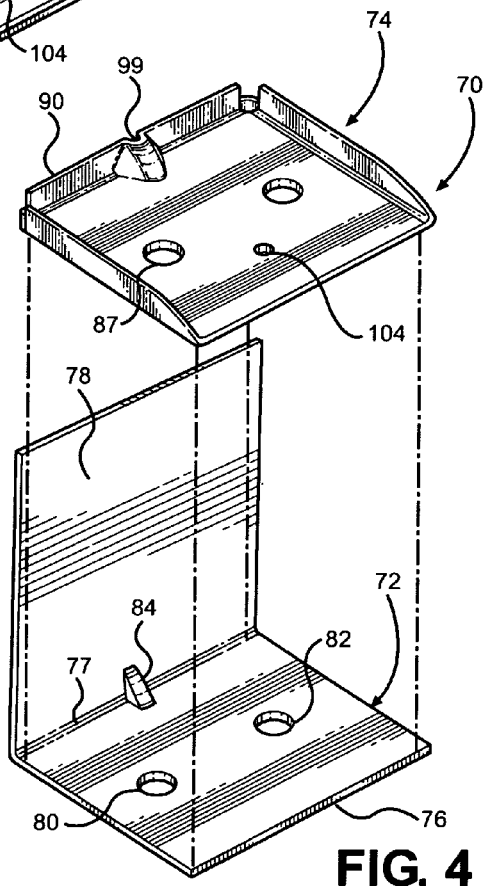
FIG. 4 is an exploded view of the bracket support assembly of the first embodiment.

The flanges 90 and 91, 92 do not have to connect at the inner edge 94, as shown in the embodiment of FIGS. 2 and 3. Inner corners 100 and 102 of the planar member 86 can be left without the upright flanges. Such design facilitates bending of metal to shape the flanges 90-92 from the same piece of metal that the planar member 86 is formed. A small hole 104 is formed a distance from the outer edge 95 of the planar member 86. An adhesive material, such as glue can be deposited into the hole 104 to temporary retain the second bracket member 74 in engagement with the first bracket member 72 during shipping.

Figure 5:
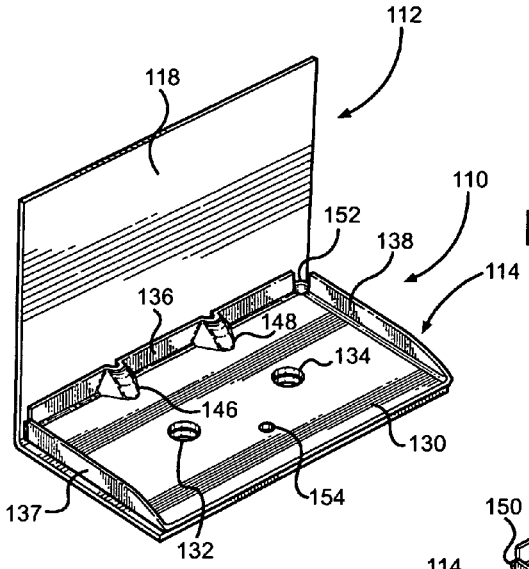
FIG. 5 is a perspective view of the bracket support assembly according to the second embodiment of the present invention.
Figure 6:
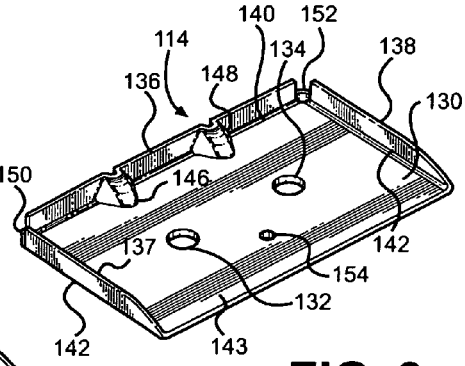
FIG. 6 is a detail perspective view of the reinforcement member for use in the bracket support assembly of the second embodiment.
Figure 7:
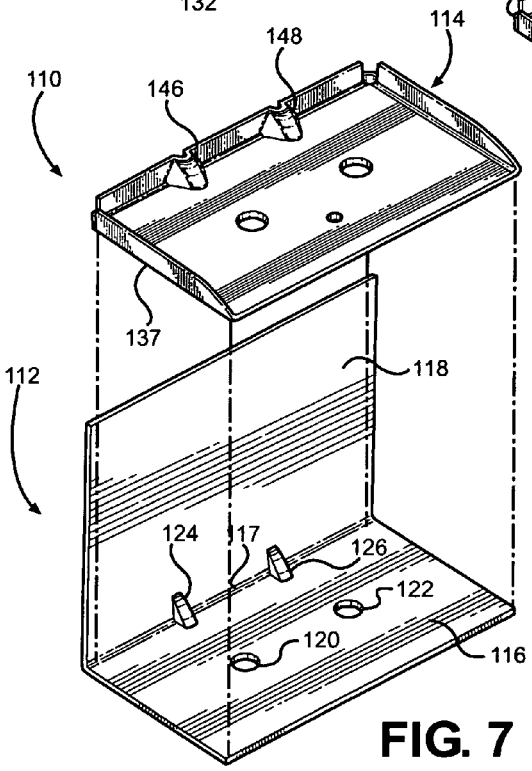
FIG. 7 is an exploded view of the bracket support assembly of the second embodiment.

Turning now to the second embodiment of the bracket support assembly of this invention shown in FIGS. 5-7, the bracket support assembly is generally designated by numeral 110. The bracket support assembly comprises an L-shaped first bracket member 112 and a second bracket member 114. Similarly to the first bracket member 72, the first bracket member 112 comprises a horizontal part 116 configured for attachment to the roof panels 18 and a vertical part 118 that fits against the horizontal part 45 of the first top member 40*c* (see FIG. 1), while being secured to the second vertical part 43. The vertical part 118 of the first bracket member 112 can be made of any required height to allow the first top member 40*c* to be elevated from the surface of the roofing panel 18 and form a straight roof line. In this embodiment, the horizontal part 116 is somewhat longer than the horizontal part 76 of the first embodiment. It is envisioned that this embodiment will be particularly useful in extreme wind conditions since the contact area with the roof panels is greater.

Also similarly to the first embodiment, a pair of apertures 120, 122 is formed in the horizontal part 116 in a spaced-apart relationship. Securing fasteners, such as screws or nails (not shown) extend through the apertures 120, 122 to attach the horizontal part 116 to the roof panels 18. A pair of spaced-apart indentations 124, 126 is formed in the horizontal part 116 centrally along an inner edge 117 of the horizontal part 116. The indentations 124, 126 extend outwardly and upwardly from the inner edge 117, which serves as a connecting line between the horizontal part 116 and the vertical part 118.

The second bracket member 114 comprises a generally rectangular planar member 130, which has an area at least slightly smaller than the area of the horizontal part 116. When the second bracket member 114 is engaged with the first bracket member 112, as shown in FIG. 5, the planar member 130 rests on top of the horizontal part 116. A pair of spaced-apart openings 132, 134 is formed in the planar member 130 in general alignment with the apertures 120, 122 in the horizontal part 116; the openings 132, 134 are configured to receive fastening elements, such as screws or nails therethrough such that the fastening elements extend through the second bracket member 114, through the first bracket member 112 and then attach the bracket assembly 110 to the roof panels 18.

The planar member 130 is provided with upwardly extending flanges 136, 137, and 138, which extend at a right angle to the top surface of the planar member 130. The inner flange 136 extends along and upwardly from an inner edge 140 of the planar member 130. The side flanges 137 and 138 extend from sides 141, 142 of the planar member 130. As in the first embodiment, the side flanges 137 and 138 can be shaped triangular in cross section, gradually decreasing in height from the inner edge 140 to an outer edge 143 of the planar member 130.

A pair of indentations 146, 148 is formed in the planar member 130 and the inner flange 136. The indentations 146, 148 follow the configuration of the indentations 124, 126 formed in the horizontal part 116. When the second bracket member 114 is engaged with the first bracket member 112 the indentations 146, 148 are aligned allowing the second bracket member 114 to snap into engagement with the first bracket member 112. As in the first embodiment, the combined thickness of the indentations further resists deformation of the bracket support members and reinforces resistance to wind forces.

The upright flanges 136, 137, and 138 do not have to connect at the inner edge 140, as shown in the embodiment of FIGS. 5 and 6. Inner corners 150, 152 of the planar member 130 can be left without the upright flanges. Such design facilitates bending of flat piece of metal and forming of the flanges 136, 137, and 138. A small hole 154 is formed a distance from the outer edge 143 of the planar member 130. An adhesive material, such as glue can be deposited into the hole 154 to temporary retain the second bracket member 114 in engagement with the first bracket member 112 during shipping.

Figure 8:
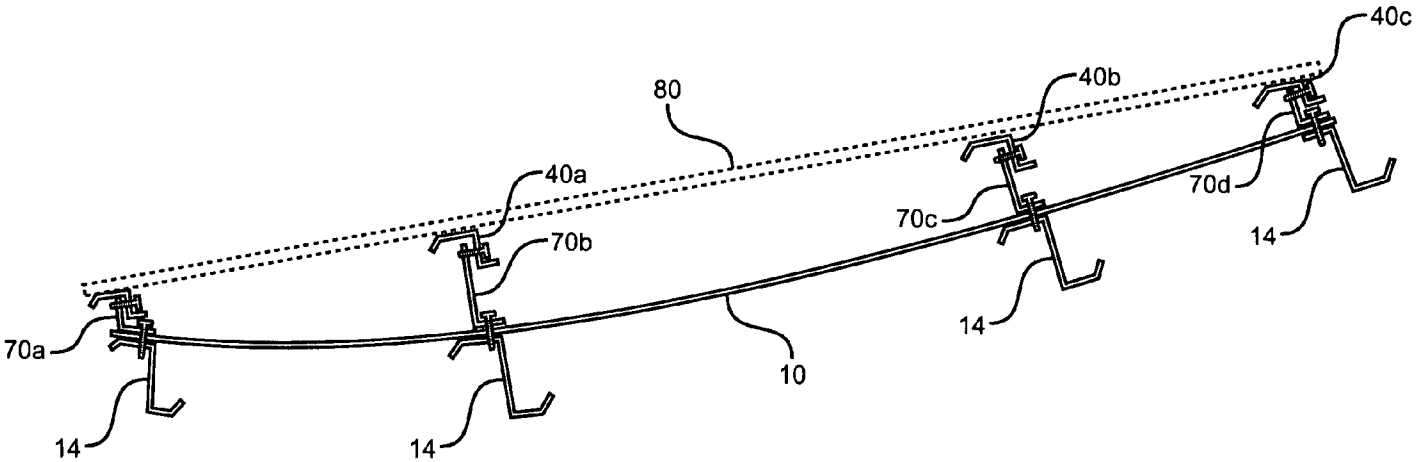
FIG. 8 is a schematic view illustrating position of the attachment members between the old roof and a new roof.

As discussed above, with time, the metal roofs 10 may sag, as for instance illustrated in FIG. 8, which makes it extremely difficult to repair. In many instances, the metal panels corrode or crack and need to be patched or completely replaced. In many climates, replacement of the existing roof must be done expeditiously for fear of exposing the interior of the building to frequent rains. The present invention permits a roofer to re-align the roof supporting surface to prepare the roof for new roof panels.

As schematically illustrated in FIG. 8, the old roof line 10 became uneven, and the support assembly of the instant invention elevated the support structure to level the roof. In FIG. 8, a plurality of bracket support assemblies 70 is provided for supporting, along with the first top members 40, a new roof 80. In this example, bracket support assemblies 70*a* and 70*d* have smaller vertical parts (78 and 118) than the vertical parts of the bracket support assemblies 70*b* or 70*c* to compensate for the sagging in the roofing panels 18.

The new roof panels 80 are positioned on top of the first top members 40, the second top member 50 and the strapping members 60. A new eave flashing can be placed along the edge of the roof in an overlapping relationship to the second top member 50. The roof panels 80 may be either R-panels or standing seam panels.

The new roof line 80 is relatively straight, eliminates sagging, and has a significantly greater number of attachment points, particularly along the peripheral line of the roof. The system of the present invention can be used to make a more stable connection of the roof portions when a building addition was made resulting in an angle change of the roof. The various size bracket support assemblies 70 are used to lift the supporting structure and eliminate the level disparity between the old roof 10 and the roof of the building addition. As a result, a new continuous roof 80 is positioned over the main building, as well as over the building addition, with the new roof 80 having an even roofline extending along a substantially even plane.

The members of the bracket support assembly are formed from a corrosion-resistant, bendable material, such as tin, aluminum or galvanized steel.

The present invention provides a reinforced attachment of the new roof, particularly along the edge of the roof. It allows installation of a new roof without the need to remove old, sometimes corroded roof panels 18. It eliminates the dangerous task of removing the old panels and solves the landfill problems. The new roof line can be made even, while the gap between the old roof panels and the new roof panels forms an insulation barrier, even if an insulation layer is not placed between the roofs. As a result the R-value of the new roof is significantly increased.

The instant invention allows quick retrofitting of the existing roof without having to rip off the existing roof and expose the contents of the building to rain, wind and dust. The center of the roof usually does not need reinforcement. Therefore the system of the present invention is particularly useful in reinforcing the peripheral edge of the building roof. It is envisioned that the wind load (wind pressure resistance) can be improved from 100 mph to about 130-140 mph.

It is envisioned that the bracket support assemblies 70 and 110 can be sold separately for use in other roofing applications.

Many changes and modifications can be made in the system of the present invention without departing from the spirit thereof. I, therefore, pray that my rights to the present invention be limited only by the scope of the appended claims.

I claim:

1. A roofing system support assembly for a new roof to be installed above an existing roof formed of preformed roof panels having a plurality of elevated ridges and drain channels, the assembly comprising:

a plurality of elongated bottom members disposed to fit into drain channels and be secured within the drain channels of the existing roof to extend about a peripheral line of the existing roof and support the new roof, each said bottom members having a height at least equal to the height of a ridge of the preformed roof panel of the existing roof;

a plurality of elongated first top members disposed to extend transversely to the bottom members and be secured at a level above the elevated ridges of the preformed roof panels of the existing roof;

a plurality of support bracket assemblies secured in the drain channels and be secured to the preformed roof panels of the existing roof and to the first top members for supporting the first top members at a desired elevation above the elevated ridges of the preformed roof panels of the existing roof, each of said support bracket assemblies comprising a horizontal portion disposed for securing to the preformed roof panel of the existing roof and a vertical portion extending transversely to the horizontal portion; and wherein said support bracket assemblies are disposed to support a new roof above an existing roof, while forming a level support for the new roof.

2. The assembly of claim 1, wherein each of the bracket support assemblies comprises a first bracket support member having a generally L-shaped configuration and a second bracket support member detachably engageable with the first bracket support member and with a preformed roof panel of the existing roof.

3. The assembly of claim 2, wherein the first bracket support member comprises a vertical part and a horizontal part, and wherein at least one upwardly extending indentation is formed in the horizontal part.

4. The assembly of claim 3, wherein vertical parts of the bracket support assemblies have sufficient vertical dimensions to support a new roof to be installed on the support assembly along a substantially even plane.

5. The assembly of claim 3, wherein the second bracket support member comprises a generally planar body configured to fit over the horizontal part of the first support member and be detachably engaged therewith.

6. The assembly of claim 5, wherein said horizontal part is provided with a pair of spaced-apart apertures, said planar body is provided with a pair of spaced-apart openings that align with the spaced-apart apertures, said apertures and said openings being each configured for receiving a fastening element therethrough for attachment of the bracket support assembly to the preformed panel of the existing roof.

7. The assembly of claim 3, the second bracket member comprising a generally planar body configured to fit over the horizontal part of the first support member, said planar body being provided with upright flanges and at least one upwardly extending indentation configured to snap over said at least one indentation formed in the horizontal part of the first bracket support member.

8. The assembly of claim 7, wherein said upright flanges comprises an inner flange extending along an inner edge of the planar body and a pair of side flanges extending along opposing sides of the planar body.

9. The assembly of claim 8, wherein said inner flange is provided with at least one indentation integrally formed with the at least one indentation of the planar body.

10. The assembly of claim 8, wherein said planar body has an outer edge and wherein vertical dimensions of the side flanges decrease toward the outer edge.

11. The assembly of claim 2, wherein each of said first top members comprises an elongated body having a Z-shaped cross-section, a first horizontal part configured for securing to the bottom member, a vertical part extending upwardly from said first horizontal part, a second horizontal part extending transversely from the vertical part and an angularly extending part unitary secured to the second horizontal part.

12. The assembly of claim 10, wherein the horizontal part of the first bracket support member is configured to be secured to the preformed roof panel, while the vertical part of the first bracket support member is configured to be secured to the vertical part of the first top member.

13. A roofing system assembly for retrofitting an existing roof formed of preformed roof panels having a plurality of elevated ridges and drain channels, with new roofing panels, the assembly comprising:

a plurality of elongated bottom members disposed to fit into drain channels and be secured to the drain channels of the existing roof to extend about a peripheral line of the roof, each said bottom members having a height at least equal to the height of a ridge of the preformed roof panel of the existing roof;

a plurality of elongated first top members disposed to extend transversely to the bottom members and be secured at a level above the elevated ridges of the preformed roof panels of the existing roof;

a plurality of bracket support assemblies secured in the drain channels and be secured to the preformed roof panels and to the first top members for supporting the first top members at a desired elevation above the elevated ridges of the preformed roof panels of the existing rood, each of the bracket support assemblies comprising a first L-shaped bracket support member having a horizontally extending part and a vertically extending part and a second bracket support member configured for engagement with the horizontally extending part of the first support member; and a second top member securing along the peripheral edge of the existing roof above the bottom member, said assembly forming a support for new roofing panels.

14. The assembly of claim 13, wherein the second bracket support member comprises a generally planar body configured to fit over the horizontal part of the first support member and be detachably engaged therewith.

15. The assembly of claim 14, wherein said horizontal part is provided with a pair of spaced-apart apertures, said planar body is provided with a pair of spaced-apart openings that align with the spaced-apart apertures, said apertures and said openings being each configured for receiving a fastening element therethrough for attachment of the bracket support assembly to the preformed panel of the existing roof.

16. The assembly of claim 14, wherein the horizontal part of the first bracket support member is provided with at least one upwardly extending indentation.

17. The assembly of claim 16, wherein said planar body is provided with upright flanges and at least one upwardly extending indentation configured to snap over said at least one indentation formed in the horizontal part of the first bracket support member.

18. The assembly of claim 17, wherein said upright flanges comprises an inner flange extending along an inner edge of the planar body and a pair of side flanges extending along opposing sides of the planar body.

19. The assembly of claim 18, wherein said inner flange is provided with at least one indentation integrally formed with the at least one indentation of the planar body.

20. The assembly of claim 18, wherein said planar body has an outer edge and wherein vertical dimensions of the side flanges decrease toward the outer edge.

* * * * *